US007611392B2

(12) United States Patent
Osborn, Jr. et al.

(10) Patent No.: US 7,611,392 B2
(45) Date of Patent: Nov. 3, 2009

(54) TERMINAL WITH INTEGRAL STRAIN RELIEF

(75) Inventors: Robert H. Osborn, Jr., Somerville, TN (US); Michael L. Pratt, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/228,929

(22) Filed: Aug. 18, 2008

(65) Prior Publication Data

US 2009/0075527 A1 Mar. 19, 2009

Related U.S. Application Data

(60) Provisional application No. 60/994,055, filed on Sep. 17, 2007.

(51) Int. Cl.
*H01R 4/10* (2006.01)

(52) U.S. Cl. ..... 439/877; 29/874

(58) Field of Classification Search ..... 439/877, 439/741; 29/53, 874, 751, 748, 747, 761, 29/861, 857

See application file for complete search history.

(56) References Cited

U.S. PATENT DOCUMENTS 2,671,889 A 3/1954 Vickery
2,749,529 A 6/1956 Curtiss
2,863,132 A 12/1958 Sowa
3,390,370 A 6/1968 Golankiewicz
3,634,817 A 1/1972 Wise
3,673,549 A 6/1972 Bliley
3,675,188 A 7/1972 Startin et al.
3,734,992 A 5/1973 Masino et al.
4,142,771 A 3/1979 Barnes et al.
4,229,063 A 10/1980 Yoshizawa
4,371,229 A 2/1983 Spangler et al.
4,692,122 A 9/1987 Montalbano
4,932,906 A 6/1990 Kaley et al.
4,950,186 A 8/1990 Kaley et al.
4,951,389 A 8/1990 Kaley et al.
5,408,743 A * 4/1995 Tournier et al. ..... 29/863
5,499,448 A * 3/1996 Tournier et al. ..... 29/863
5,522,739 A 6/1996 Axelsson

* cited by examiner

*Primary Examiner*—Ross N Gushi
(74) *Attorney, Agent, or Firm*—Hoffmann & Baron, LLP

(57) ABSTRACT

A terminal and a method for making a terminal that includes a connector end and a terminal barrel, preferably formed from a sheet of metal. The terminal barrel includes a cylindrical wall having a first section corresponding to a first end and a second section corresponding to a second end. The thickness of the first section is reduced so that it is less than the thickness of the second section and the first section is flared to increase the diameter. The first end is flared after a nylon or plastic insulator is fitted over the terminal barrel. The first end is adapted for receiving an electrical conductor and the second end connects to the connector end.

21 Claims, 3 Drawing Sheets

TERMINAL WITH INTEGRAL STRAIN RELIEF

This application claims priority from provisional application Ser. No. 60/994,055, filed on Sep. 17, 2007, which is incorporated herein in its entirety.

FIELD OF THE INVENTION

The present invention relates to a terminal of the type that is mechanically crimped to the stripped portion of an electrical conductor. In particular, the present invention relates to a terminal with an integral strain relief for securing the insulated portion of an electrical conductor.

BACKGROUND OF INVENTION

Most types of crimp-on terminals (or lugs) are attached to wires to allow the wires to be easily connected to screw terminals and fast-on or quick-disconnect terminals. Crimp-on terminals are attached by inserting the stripped end of a stranded wire into the tubular portion of the terminal. The tubular portion of the terminal is then compressed or crimped tightly around the wire by squeezing it with a crimping tool.

Typically, nylon terminals are made up of three components; a connector with integral barrel (ring, fork, etc.), a thin sleeve, and a plastic insulator. The connector and terminal barrel are formed from a sheet metal stamping defining a substantially flat connector portion with either an aperture or fork at the end and a rectangular sleeve or barrel forming portion. After stamping, the rectangular portion is rolled or folded about a mandrel into a tube (referred to herein as "the terminal barrel") with the side edges abutting each other to form a seam. A thin metal sleeve is snugly fitted over the rolled end and extends past the wire entry barrel end. The sleeve's primary function is to provide strain relief around the wire insulation when it is crimped. Finally, a nylon insulator is fitted over the metal sleeve. Nylon material has memory effect, i.e., it has a tendency to return back to its original processed shape after nylon insulator is crimped. Because of this memory effect, a crimped nylon insulator performs poorly as a strain relief.

Once assembled, a portion at the wire-receiving end of the insulated terminal (at the end opposing the connector) is flared outwardly to increase the inner diameter ("ID"), while the ID of the remaining portion remains unchanged. A conductor with the insulation stripped from the end is inserted into the terminal barrel. The stripped portion of the conductor is received by the unflared portion of the terminal barrel and the insulated portion of the conductor is received by the flared portion. Both the flared and unflared portions of the terminal barrel are then crimped to provide a mechanical strain relief and an electrical connection. When the flared portion of the terminal barrel is crimped, the sleeve forms around the insulation of the conductor to provide strain relief. This construction method is used specifically for nylon insulated terminals, which do not retain their crimped shape well and tend to separate from the insulation of the conductor if a sleeve is not included. Without a sleeve, a crimped nylon insulator provides little or no strain relief. In contrast, vinyl insulated terminals retain their crimped shape and do not require a sleeve to provide good strain relief.

However, vinyl insulators cannot be used in many applications that require terminals rated for high temperatures, increased chemical resistance, impact resistance and/or abrasion resistance. Moreover, the construction method used for nylon insulators requires an additional part (the sleeve) and is, therefore, costly to produce and assemble. Accordingly, there is a need for a high temperature plastic or nylon insulated terminal that is less costly to manufacture and easier to fabricate.

SUMMARY OF THE INVENTION

The present invention is a terminal and a method for making a terminal. The terminal includes a connector end and a terminal barrel, preferably formed from one sheet of metal. The connector end includes a connector, preferably a ring, fork or quick-disconnect connector. The terminal barrel includes a cylindrical wall having an interior surface, a diameter, a first section corresponding to a first end and having a first thickness, and a second section corresponding to a second end and having a second thickness. The first end is adapted for receiving an electrical conductor and the second end connects to the connector end. The terminal can also include a nylon or plastic insulator, which fits over the terminal barrel. When an insulator is included, the first end is flared after the insulator is fitted over the terminal barrel.

In addition, the thickness of the first section is reduced so that it is less than the thickness of the second section and the first section is flared to increase the diameter. The interior surface of the wall at the first end of the terminal barrel can be coined to reduce the thickness. Preferably, the thickness of the first section of the wall is reduced by about from 0.2% to about 20%, more preferably from about 0.5% to about 5%.

The method of making the terminal includes the steps of:

(1) cutting or stamping a piece of sheet metal to form a metal shape that includes a connector end and a terminal barrel end, wherein the terminal barrel end comprises a pair of sides, a first section, a second section and a notch in each side between the first and second sections, wherein the first section has a thickness and a top surface, and wherein the second section connects to the connector end;

(2) coining the top surface of the first section to reduce the thickness and form a coined section;

(3) forming the terminal barrel end into a cylinder having an inner diameter, an outer diameter and an interior surface, wherein the sides are substantially abutted, and wherein the coined section extends radially on the interior surface;

(4) installing an insulating sleeve over the cylinder; and (5) flaring the coined section of the cylinder to increase the inner diameter and the outer diameter of the coined section.

The connector end can include an aperture or a slot and the insulating sleeve can be made of nylon or vinyl. The terminal barrel has a first end and a second. The first end is adapted for receiving an electrical conductor. The coining can be carried out using a gear driven press, a mechanical press, or a hydraulically actuated press. The coining reduces the thickness of the first section by about from 0.2% to about 20% and preferably by about from 0.5% to about 5%.

BRIEF DESCRIPTION OF THE FIGURES

The preferred embodiments of the terminal of the present invention, as well as other objects, features and advantages of this invention, will be apparent from the accompanying drawings wherein.

DETAILED DESCRIPTION OF THE INVENTION

Figure 1:
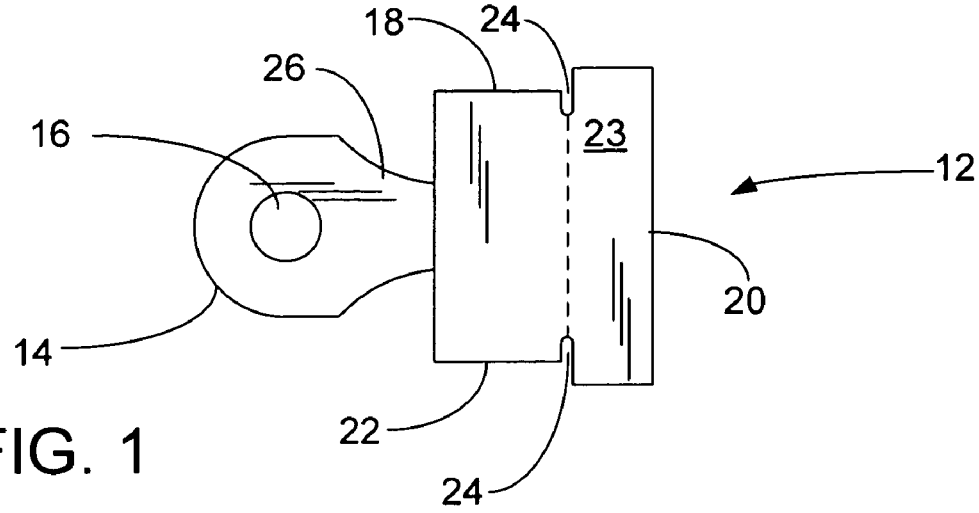
FIG. 1 is a top view of a stamped out piece of sheet metal that is used to form an embodiment of the terminal.

The present invention is a terminal that secures the stripped end of a conductor and provides strain relief for the insulated portion. The terminal eliminates one of the three components (the thin sleeve) used in prior art designs and includes an additional manufacturing step. After a piece of sheet metal (preferably made of copper) is stamped and before the blank metal has its end rolled into a cylinder, an edge of it is "coined" or thinned so that, when the cylinder is formed, it no longer has a uniform inside diameter. After the cylinder is formed, the abutting edges are brazed together. Thereafter, the insulator is placed over the cylinder and the thin end of the cylinder and the insulator are both flared as described in more detail below.

The terminal includes a ring, fork or quick disconnect connector that is integrally formed with a terminal barrel section that fits into a cylindrically-shaped insulator. The quick disconnect terminals have either a male or female connector that mates with a corresponding female or male connector. Typically, quick disconnect terminals are blades configured to connect to industry standard receptacles. The first end of the terminal barrel section that receives a stripped electrical conductor is flared to increase the ID. The increased ID is sufficient to allow the stripped portion of the conductor to pass through to the second end. However, the outer diameter ("OD") of the insulated portion of the conductor is too large to pass into the second end of the terminal barrel but snugly fits into the first end. The first end of the terminal barrel is crimped to hold the insulated portion of the conductor and provide strain relief. The second end of the terminal barrel is crimped to securely hold the stripped portion of the conductor in the terminal.

The inner diameters of the first and second sections of the terminal barrel are selected to correspond to the dimensions of the insulated and stripped portions, respectively, of different size conductors (also referred to as different wire gauges). When a conductor is inserted into the terminal barrel, the stripped portion easily passes through the first section of the terminal barrel until the insulated portion, which has an OD greater than the ID of the second section of the terminal barrel, prevents further insertion. The first and second sections of the terminal barrel are then crimped to secure the insulated and stripped portions, respectively, of the conductor. The crimped first section forms around the insulation of the conductor and provides strain relief from vibration and movement that could compromise the mechanical and electrical integrity of the crimped conductor. The crimped second section provides an electrical and mechanical connection for the stripped end of the conductor.

The integral strain relief, in the first section of the terminal barrel, is created during the stamping and fabricating operations that are used to form the terminal barrel. Initially, a piece of sheet metal is stamped or cut into a flat shape with one end having a ring or fork connector and the other end having a rectangular section that is rolled to form a terminal barrel. Before the rectangular section is rolled into a terminal barrel, the integral strain relief is created by coining the end of the rectangular section opposite the connector end. The coining operation thins the rectangular section on the inside surface at the end opposite the connector end. After the rectangular section is rolled into a cylindrical shape, this produces a terminal barrel that has a larger ID at the end that receives the conductor and a substantially uniform outer diameter along its entire length. Thus, the barrel and integral strain relief have about the same OD, but the strain relief section has a larger ID for accommodating the insulated portion of a conductor.

As used herein, the term "coining" refers to a form of precision metal working or stamping, wherein the thickness of a material, typically a piece of metal, is reduced. Coining differs from simple stamping in that enough pressure is used to cause plastic flow of the surface of the material. Coining is a cold working process that can be done using a gear driven press, a mechanical press, or more commonly, a hydraulically actuated press. Coining typically requires more force than stamping, because the material is plastically deformed and not actually cut, as in stamping. As used herein to describe the present invention, the term coining is not intended to be limiting in any way and includes any process that reduces the thickness of a material by the application of force to the surface of the material.

The cylindrically shaped terminal barrel has an abutted (i.e., the rectangular section is rolled up so that the opposing sides contact each other) and, preferably, brazed seam where the two sides of the rectangular section are joined. A nylon insulator can then be snugly fitted onto the uniform OD of the terminal barrel. A flaring operation is performed on the coined end of the terminal barrel to expand the integral strain relief section and the insulator to increase the ID and OD. Typically, a flaring operation includes the insertion of a tool, such as a mandrel, into the end of a tube or pipe which applies pressure and forces the wall to expand radially outwardly. Alternatively, the first end of the terminal barrel can be flared before an insulator is fitted on the barrel. After the flaring operation is completed, the insulator is molded over the flared terminal barrel. The larger ID of the strain relief section accommodates the insulated portion of the conductor. The coined wall of the strain relief portion of the terminal barrel can then be easily formed around a conductor's insulation during crimping.

In a preferred embodiment, notches are formed on the opposing sides of the rectangular section of the stamped sheet metal at the transition between the coined and uncoined surfaces. When the rectangular section is rolled into a tube to form the terminal barrel, the notches are joined and form a relief hole. The relief hole extends through the wall of the terminal barrel at the point where the transition from the second section to the integral strain relief first section begins. Instead of forming the relief hole using notches, it can also be made, after the terminal barrel is formed, by cutting an aperture at the seam where the two sides of the rectangular section join. When the sides are abutted and the seam formed by the second section is brazed, the relief hole prevents the brazed seam from separating along the barrel body section when the flaring operation is performed on the strain relief section.

The method of constructing this connector is more clearly understood by viewing the accompanying drawings. FIGS. 1-4 illustrate the steps used to fabricate an embodiment of the terminal 10 of the present invention. FIG. 1 shows a piece of sheet metal 12 that has been cut or stamped into the desired shape for the terminal 10. One end of the sheet metal 12 has a ring connector 14 with an aperture 16 and it is connected by a neck 26 to a rectangular section 18 at the opposite end. The rectangular section 18 has a second portion 22 that connects to the neck 26 and a first portion 20 that has a greater width than the second portion 22. A notch 24 is located on each side of the rectangular section 18 at the point where the width of the rectangular section 18 changes.

After the sheet metal 12 is cut or stamped, it is coined on the surface 23 to reduce the thickness of the first portion 20 of the rectangular section 18. The rectangular section 18 is then formed into a cylindrically shaped terminal barrel 30 with an opening 32 and with the opposing sides of the second portion 22 of the rectangular section 18 forming a seam 28 (see FIG. 2) and the two notches 24 forming an aperture 25, which provides strain relief and prevents cracking along the brazed seam. The first portion 20 of the terminal barrel 30 has a greater width than the second portion 22 so that the opposing sides of the first portion 20 overlap when the terminal barrel 30 is formed. When the rectangular section 18 of the sheet metal 12 is formed into the terminal barrel 30, the second portion 22 forms the body 40 of the terminal barrel 30 and the first portion 20 forms the strain relief section 38.

Figure 2:
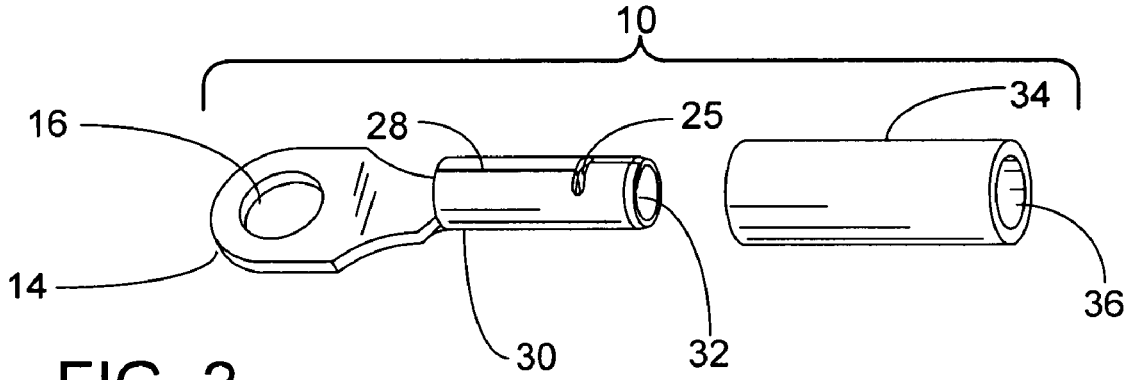
FIG. 2 is a perspective view of the piece of sheet metal shown in FIG. 1 after one end has been formed into a terminal barrel and a cylindrical insulator.
Figure 3:
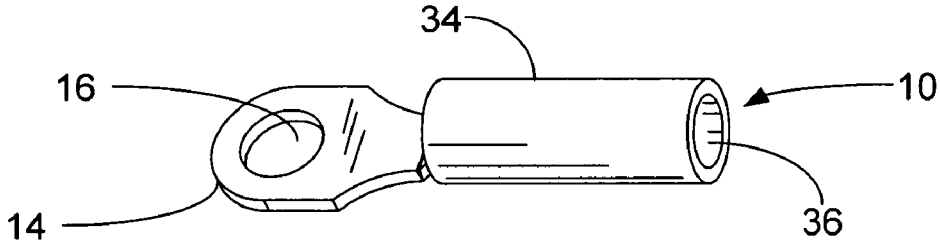
FIG. 3 is a perspective view of the terminal in FIG. 2 after the cylindrical insulator is fitted over the terminal barrel connector.
Figure 4:
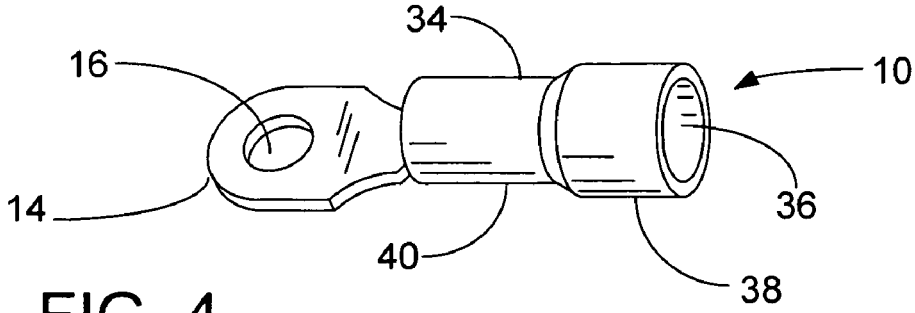
FIG. 4 is a perspective view of the terminal in FIG.3 after the end of the terminal barrel that receives a conductor has been flared.

FIG. 2 shows a cylindrical insulator 34 with an opening 36 that has an ID that is about the same as the OD of the terminal barrel 30. The insulator 34 is snugly fitted over the terminal barrel 30 (FIG. 3) and the strain relief section 38 is flared to increase the ID and OD of the strain relief section 38 as shown in FIG. 4.

Figure 5:
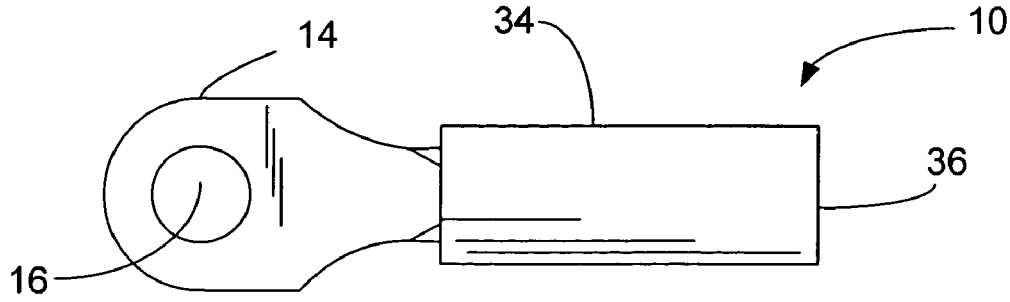
FIG. 5 is a top view of an embodiment of the terminal before the insulated end is flared.
Figure 6:
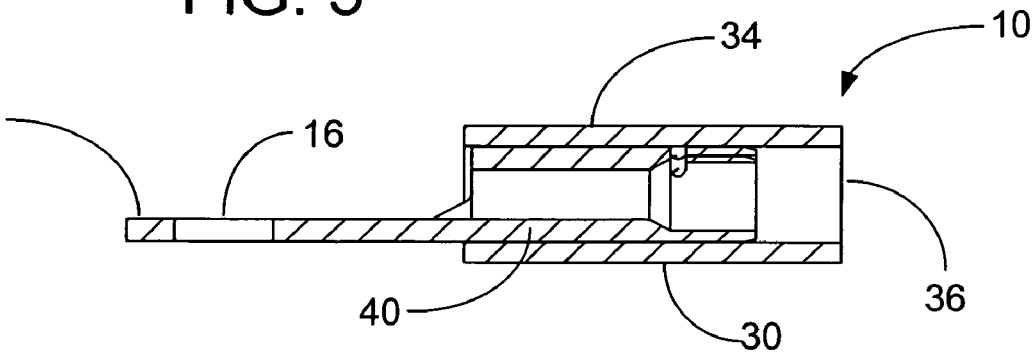
FIG. 6 is a cut-away side view of the terminal shown in FIG. 5.

FIGS. 5 and 6 show the terminal 10 after the insulator 34 is fitted over the terminal barrel and before the strain relief section 38 is flared to increase the diameter. FIG. 6 is a sectional view of the terminal 10 and it shows that the OD of the terminal barrel 30 is uniform and that the ID of the body 40 is less than the ID of the strain relief section 38 due to the coining.

Figure 7:
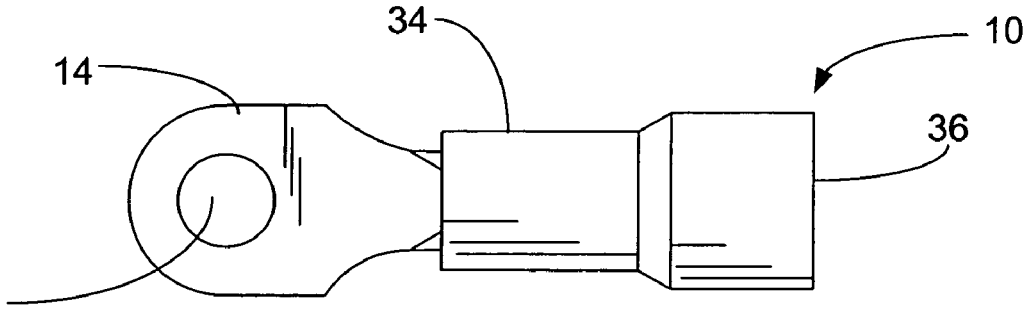
FIG. 7 is a top view of an embodiment of the terminal after the insulated end is flared.
Figure 8:
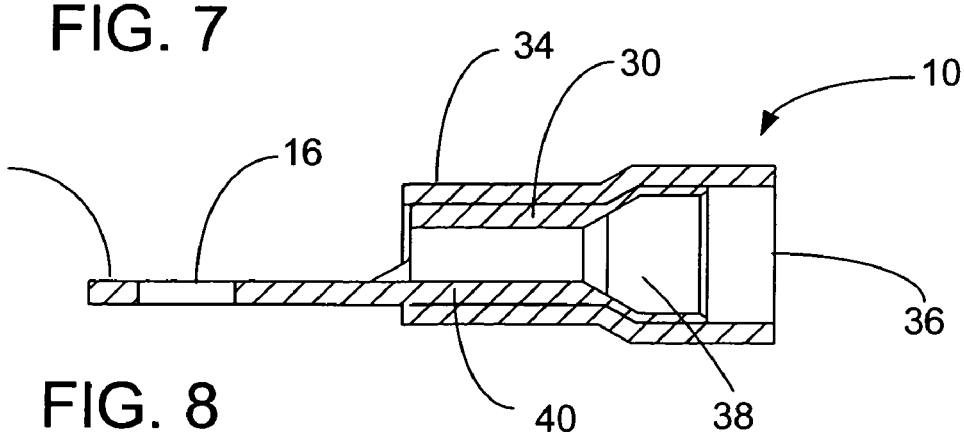
FIG. 8 is a cut-away side view of the terminal shown in FIG. 7.

FIGS. 7 and 8 show the terminal 10 after the strain relief section 38 is flared to increase the diameter. The flaring operation increases both the ID and OD of the strain relief section 38 but does not change the ID or OD of the body 40. FIG. 8 is a sectional view of the terminal 10 and it shows the increased ID and OD of the strain relief section 38 as a result of the flaring operation. The ID of the body section 40 is constructed so that the strands of a stripped conductor snugly fit into the body section 40 and the ID of the strain relief section 38 is constructed so that an insulated conductor snugly fits into the strain relief section 38.

Figure 9:
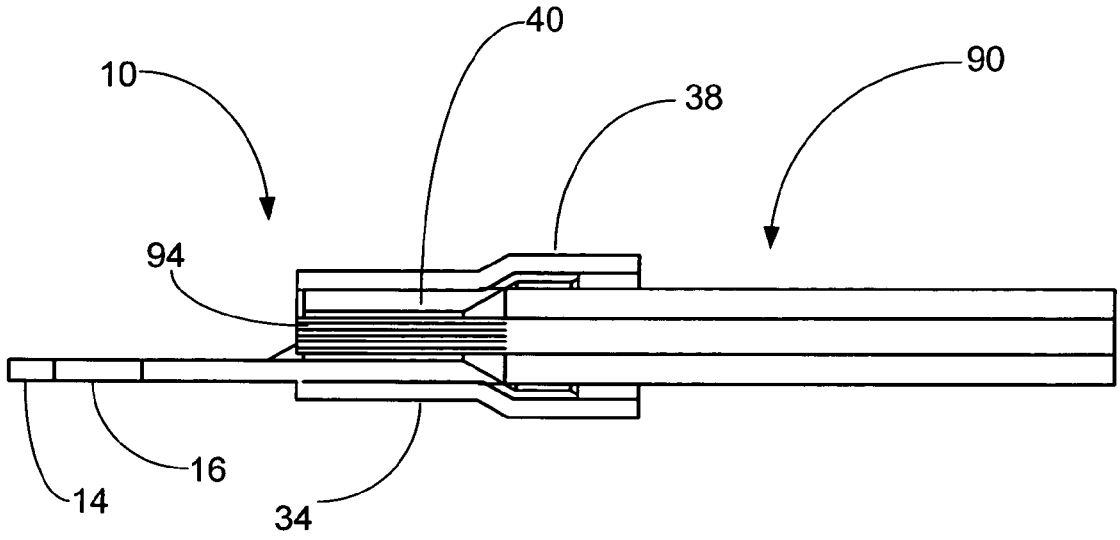
FIG. 9 is a cut-away side view of an embodiment of the terminal with a conductor inserted in the connector prior to crimping.
Figure 10:
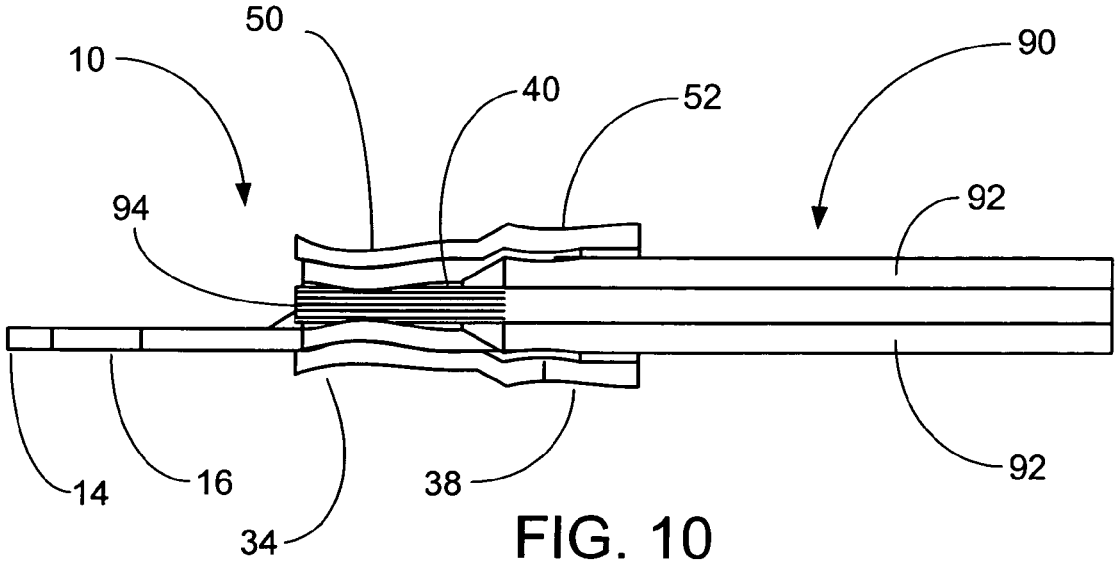
FIG. 10 is a cut-away side view of the terminal shown in FIG. 9 after both sections of the terminal barrel are crimped.

FIGS. 9 and 10 are cut-away side views and they show a conductor 90 with an insulating jacket 92 surrounding strands of wire 94 inserted into a terminal 10. In FIG. 9, the conductor 90 is inserted into the terminal 10 with the uninsulated wire strands 94 located in the body 40 and the conductor 90 with insulation 92 located in the strain relief section 38. The ID of the body and strain relief section 38 are selected so that the OD of the insulated conductor 90 is too large to pass into the body section 40 of the terminal 10. The terminal 10 can be made with different dimensions to accommodate conductors 90 of different sizes.

FIG. 10 shows the terminal 10 in FIG. 9 after both the body section 40 and the strain relief section 38 of the terminal barrel 34 have been crimped. The crimped section 50 of the body 40 secures the wire strands 94 in the terminal 19 and provides good electrical contact between the conductor 90 and the connector 10. The crimped section 52 of the strain relief section 38 mechanically secures the conductor 90 in the terminal 10 and relieves the strain on the crimped connection between the wire strands 94 and the body 40.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A terminal comprising:

a connector end comprising a connector;

a terminal barrel comprising a cylindrical wall having an interior surface, a diameter, a first section corresponding to a first end and having a first thickness, and a second section corresponding to a second end and having a second thickness, wherein the first end is adapted for receiving an electrical conductor and the second end connects to the connector end, wherein the thickness of the first section is reduced so that it is less than the thickness of the second section, and wherein the first section is flared to increase the diameter; and an insulator, wherein the insulator fits over the terminal barrel.

2. The terminal according to claim 1, wherein the insulator is made from nylon or plastic.

3. The terminal according to claim 1, wherein the first end is flared after the insulator is fitted over the terminal barrel.

4. The terminal according to claim 1, wherein the connector is a ring, fork or quick-disconnect connector.

5. The terminal according to claim 1, wherein the interior surface of the wall at the second end of the terminal barrel is coined.

6. The terminal according to claim 1, wherein the connector end and the terminal barrel are formed from a sheet of metal.

7. A method of making a terminal comprising:

cutting or stamping a piece of sheet metal to form a metal shape comprising a connector end and a terminal barrel end, wherein the terminal barrel end comprises a pair of sides, a first section, a second section and a notch in each side between the first and second sections, wherein the first section has a thickness and a top surface, and wherein the second section connects to the connector end;

coining the top surface of the first section to reduce the thickness and form a coined section;

forming the terminal barrel end into a cylinder having an inner diameter, an outer diameter and an interior surface, wherein the sides are substantially abutted, and wherein the coined section extends radially on the interior surface;

installing an insulating sleeve over the cylinder; and flaring the coined section of the cylinder to increase the inner diameter and the outer diameter of the coined section.

8. The method of making a terminal according to claim 7, wherein the connector end comprises an aperture or a slot.

9. The method of making a terminal according to claim 7, wherein the insulating sleeve is made of nylon or vinyl.

10. The method of making a terminal according to claim 7, wherein the terminal barrel has a first end and a second, and wherein the first end is adapted for receiving an electrical conductor.

11. The method of making a terminal according to claim 7, wherein the coining is carried out using a gear driven press, a mechanical press, or a hydraulically actuated press.

12. The method of making a terminal according to claim 7, wherein the coining reduces the thickness of the first section by about from 0.2% to about 20%.

13. The method of making a terminal according to claim 7, wherein the coining reduces the thickness of the first section by about from 0.5% to about 5%.

14. A method of making a terminal comprising:

cutting or stamping a piece of sheet metal to form a metal shape comprising a connector end and a terminal barrel end, wherein the terminal barrel end comprises a pair of sides, a first section, a second section and a notch in each side between the first and second sections, wherein the first section has a thickness and a top surface, and wherein the second section connects to the connector end;

coining the top surface of the first section to reduce the thickness and form a coined section, wherein the coining reduces the thickness of the first section by about from 0.2% to about 20%;

forming the terminal barrel end into a cylinder having a first end, a second, an inner diameter, an outer diameter and an interior surface, wherein the sides are substantially abutted, wherein the coined section extends radially on the interior surface, and wherein the first end is adapted for receiving an electrical conductor;

installing an insulating sleeve over the cylinder; and flaring the coined section of the cylinder to increase the inner diameter and the outer diameter of the coined section.

15. The method of making a terminal according to claim 14, wherein the connector end comprises an aperture or a slot.

16. The method of making a terminal according to claim 14, wherein the insulating sleeve is made of nylon or vinyl.

17. The method of making a terminal according to claim 14, wherein the coining is carried out using a gear driven press, a mechanical press, or a hydraulically actuated press.

18. The method of making a terminal according to claim 14, wherein the coining reduces the thickness of the first section by about from 0.5% to about 5%.

19. A terminal comprising:

a connector end comprising a connector; and a terminal barrel comprising a cylindrical wall having an interior surface, a diameter, a first section corresponding to a first end and having a first thickness, and a second section corresponding to a second end and having a second thickness, wherein the first end is adapted for receiving an electrical conductor and the second end connects to the connector end, wherein the thickness of the first section is reduced so that it is less than the thickness of the second section, and wherein the first section is flared to increase the diameter, wherein the connector end and the terminal barrel are formed from a sheet of metal.

20. The terminal according to claim 19, wherein the connector is a ring, fork or quick-disconnect connector.

21. The terminal according to claim 19, wherein the interior surface of the wall at the second end of the terminal barrel is coined.

* * * * *